US011536449B2

(12) United States Patent
Williams

(10) Patent No.: US 11,536,449 B2
(45) Date of Patent: Dec. 27, 2022

(54) TIERED BURNER

(71) Applicant: Rafe Tierra Williams, Anaheim, CA (US)

(72) Inventor: Rafe Tierra Williams, Anaheim, CA (US)

( * ) Notice: Subject to any disclaimer, the term of this patent is extended or adjusted under 35 U.S.C. 154(b) by 0 days.

(21) Appl. No.: 16/084,210

(22) PCT Filed: Feb. 1, 2018

(86) PCT No.: PCT/US2018/016512
§ 371 (c)(1),
(2) Date: Sep. 11, 2018

(87) PCT Pub. No.: WO2018/144776
PCT Pub. Date: Aug. 9, 2018

(65) Prior Publication Data

US 2019/0072271 A1 Mar. 7, 2019

Related U.S. Application Data

(60) Provisional application No. 62/453,463, filed on Feb. 1, 2017.

(51) Int. Cl.
*F23D 14/06* (2006.01)
*F24C 3/08* (2006.01)

(52) U.S. Cl.
CPC .. *F23D 14/065* (2013.01); *F23D 2900/14062* (2013.01); *F24C 3/085* (2013.01)

(58) Field of Classification Search
CPC ..... F23D 14/065; F23D 2900/14062; F24C 3/085
See application file for complete search history.

(56) References Cited

U.S. PATENT DOCUMENTS 1,932,743 A * 10/1933 Kunz ..... F23D 14/06 239/288.5
RE20,662 E * 2/1938 Schneider ..... F23D 14/06 126/39 R (Continued)

FOREIGN PATENT DOCUMENTS

CA 101037719 A 9/2007
CA 2893432 A1 6/2014

(Continued)

OTHER PUBLICATIONS

International Search Report and Written Opinion of the International Search Authority issued by ISA/US dated Apr. 6, 2018.

(Continued)

*Primary Examiner* — Michael G Hoang
*Assistant Examiner* — Logan P Jones
(74) *Attorney, Agent, or Firm* — CIONCA IP Law P.C.; Marin Cionca

(57) ABSTRACT

A tiered burner having a Venturi tube in fluid communication with and connected to a chamber, the chamber being in fluid communication with rows of burner ports; the chamber having an outer wall and an inner wall; a plurality of vanes having a tiered arrangement, wherein the lowermost vane of the plurality of vanes is the smallest vane; each vane of the plurality of vanes having an inner edge extending from the inner wall towards a center of the plurality of vanes, and extending above a row of burner ports of the plurality of rows, such that flames emitted from the row of burner ports is impinged from above and thus directed towards the center of the plurality of vanes; and the Venturi tube having: a constricted midsection; a first end creating a connection to the chamber; and a second end configured to receive gas from a gas source.

17 Claims, 13 Drawing Sheets

(56) References Cited

U.S. PATENT DOCUMENTS 2,148,777 A * 2/1939 Schneider ..... F23D 14/06 126/39 H
2,337,240 A * 12/1943 Harper ..... F23D 14/065 239/425.5
2,525,960 A * 10/1950 Shaw ..... F23D 14/045 239/423
3,131,752 A * 5/1964 Blanzy ..... F23D 14/26 431/349
3,627,462 A * 12/1971 Lotter ..... F23D 14/06 431/284
4,827,898 A * 5/1989 Liao ..... F23D 14/065 126/39 E
5,639,232 A * 6/1997 Bogenschutz ..... F23D 14/065 126/39 E
6,688,882 B1 * 2/2004 Williams ..... F23C 7/008 126/39 E
8,220,450 B2 7/2012 Luo
8,616,193 B2 12/2013 Padgett
2006/0024632 A1 * 2/2006 Sanchez ..... F23D 14/06 431/354
2006/0147865 A1 7/2006 Czajka et al.
2009/0320823 A1 * 12/2009 Padgett ..... F23D 14/06 126/39 E

FOREIGN PATENT DOCUMENTS

EP 2290287 3/2011
JP 2005337685 A * 12/2005
JP 2011220653 A * 11/2011

OTHER PUBLICATIONS

Notice of Allowance issued by Canada, dated Sep. 9, 2021.
Office Action issued by China, dated Jul. 9, 2021.
Office Action issued by Canada, dated Apr. 26, 2021.
Office Action issued by Canada, dated Nov. 25, 2020.
Office Action issued by China, dated Nov. 23, 2020.

* cited by examiner

TABLE 1

| Test Run | Date | Gas Type | Start Temp | Stove Operated (Minutes) | Pot Size | H2O Amount lbs. | Burner Orifice | Est. BTU Input Rate | Burner Head Configuration Dia - Rows - Lvls | | | Shutter Opening | Inlet Presure in/wc | Grate Height | Heating BTU's | Burner BTU's | Est Efficiency |
|---|---|---|---|---|---|---|---|---|---|---|---|---|---|---|---|---|---|
| 74 | 11/14/2017 | LP | 108.0 | [illegible] | 13 | 14 | 56 | 10000 | 0.078 | | 4 | 0.750 | 5 | 1.000 | 1,358.8 | 2,180.6 | 62.3% |
| 63 | 5/30/2017 | LP | 71.6 | [illegible] | 13 | 15 | 56 | 15100 | 0.076 | J | 4 | 0.750 | 11 | 0.625 | 2,024.9 | 3,506.6 | 57.7% |
| 65 | 6/8/2017 | LP | 76.4 | [illegible] | 13 | 14 | 55 | 19000 | 0.076 | J | 4 | 0.750 | 11 | 1.000 | 1,825.6 | 3,245.8 | 56.2% |
| 11 | 4/25/2017 | Nat | 69.8 | [illegible] | 13 | 14 | 49 | 17500 | 0.062 | 2 | 4 | 0.750 | 5 | 0.625 | 1,923.1 | 3,431.9 | 56.0% |
| 73 | 11/14/2017 | LP | 83.6 | [illegible] | 13 | 14 | 56 | 15000 | 0.078 | | 4 | 0.750 | 5 | 1.000 | 1,719.2 | 3,100.0 | 55.5% |
| 44 | 5/10/2017 | LP | 68.9 | [illegible] | 13 | 14 | 56 | 15100 | 0.076 | G | 4 | 0.750 | 11 | 0.625 | 1,936.3 | 3,494.0 | 55.4% |
| 45 | 5/10/2017 | LP | 68.0 | [illegible] | 13 | 14 | 56 | 15100 | 0.076 | G | 4 | 0.750 | 11 | 0.625 | 1,949.6 | 3,527.5 | 55.3% |
| 61 | 5/25/2017 | LP | 68.9 | [illegible] | 13 | 14 | 56 | 15100 | 0.076 | J | 4 | 0.750 | 11 | 0.625 | 1,936.3 | 3,506.6 | 55.2% |
| 6 | 4/24/2017 | Nat | 75.0 | [illegible] | 10 | 10 | 50 | 16600 | 0.062 | 2 | 4 | 0.750 | 7 | 0.625 | 1,318.8 | 2,397.8 | 55.0% |
| 33 | 5/3/2017 | Nat | 71.0 | [illegible] | 13 | 14 | 48 | 19000 | 0.078 | C | 4 | 0.750 | 5 | 0.625 | 1,905.3 | 3,483.3 | 54.7% |
| 66 | 6/8/2017 | LP | 74.3 | [illegible] | 13 | 14 | 55 | 19000 | 0.078 | H | 4 | 0.750 | 11 | 1.000 | 1,856.6 | 3,409.4 | 54.5% |
| 64 | 6/8/2017 | LP | 77.0 | [illegible] | 13 | 14 | 55 | 19000 | 0.076 | J | 4 | 0.750 | 11 | 1.000 | 1,816.7 | 3,340.8 | 54.4% |
| 12 | 4/25/2017 | Nat | 73.4 | [illegible] | 10 | 10 | 49 | 17000 | 0.062 | 2 | 4 | 0.750 | 5 | 0.500 | 1,335.6 | 2,507.0 | 53.3% |
| 5 | 4/24/2017 | Nat | 70.0 | [illegible] | 10 | 10 | 48 | 19000 | 0.062 | 2 | 4 | 0.750 | 5 | 0.625 | 1,371.5 | 2,612.5 | 52.5% |
| 29 | 5/2/2017 | Nat | 68.0 | [illegible] | 13 | 14 | 49 | 17500 | 0.078 | A | 4 | 0.750 | 5 | 0.625 | 1,949.6 | 3,723.6 | 52.4% |
| 30 | 5/2/2017 | Nat | 74.8 | [illegible] | 13 | 14 | 49 | 17500 | 0.062 | B | 4 | 0.750 | 5 | 0.625 | 1,849.2 | 3,538.9 | 52.3% |
| 25 | 5/1/2017 | Nat | 75.2 | [illegible] | 13 | 14 | 48 | 19000 | 0.078 | A | 4 | 0.750 | 5 | 0.625 | 1,843.3 | 3,541.4 | 52.1% |
| 49 | 5/11/2017 | Nat | 71.0 | [illegible] | 13 | 14 | 49 | 17500 | 0.078 | J | 4 | 0.750 | 5 | 0.625 | 1,905.3 | 3,796.5 | 50.2% |
| 7 | 4/24/2017 | Nat | 74.0 | [illegible] | 10 | 10 | 50 | 16600 | 0.062 | 2 | 4 | 0.750 | 5 | 0.625 | 1,329.3 | 2,674.4 | 49.7% |
| 40 | 5/8/2017 | Nat | 65.0 | [illegible] | 13 | 14 | 49v | 17500 | 0.078 | F | 4 | 0.750 | 5 | 0.625 | 1,994.0 | 4,015.3 | 49.7% |
| 71 | 6/9/2017 | Nat | 70.3 | [illegible] | 13 | 14 | 49 | 20000 | 0.078 | H | 4 | 0.750 | 5 | 1.000 | 1,915.7 | 3,877.8 | 49.4% |
| 27 | 5/1/2017 | Nat | 71.6 | [illegible] | 13 | 14 | 49 | 17500 | 0.078 | A | 4 | 0.750 | 5 | 0.625 | 1,896.5 | 3,840.3 | 49.4% |
| 67 | 6/8/2017 | Nat | 73.4 | [illegible] | 13 | 14 | 48 | 19000 | 0.078 | H | 4 | 0.750 | 5 | 1.000 | 1,869.9 | 3,805.3 | 49.1% |
| 58 | 5/24/2017 | Nat | 74.2 | [illegible] | 13 | 14 | 49 | 17500 | 0.078 | H | 4 | 0.800 | 5 | 0.750 | 1,858.1 | 3,786.8 | 49.1% |
| 47 | 5/11/2017 | Nat | 66.4 | [illegible] | 13 | 14 | 49 | 17500 | 0.078 | H | 4 | 0.750 | 5 | 0.625 | 1,973.3 | 4,039.6 | 48.8% |
| 70 | 6/8/2017 | Nat | 71.6 | [illegible] | 13 | 21 | 49 | 17500 | 0.078 | H | 4 | 0.750 | 5 | 1.000 | 2,795.3 | 5,726.4 | 48.8% |
| 42 | 5/9/2017 | Nat | 67.8 | [illegible] | 13 | 14 | 49v | 17500 | 0.076 | G | 4 | 0.750 | 5 | 0.625 | 1,952.6 | 4,005.6 | 48.7% |
| 8 | 4/24/2017 | Nat | 76.0 | [illegible] | 10 | 10 | 50 | 16600 | 0.062 | 2 | 4 | 0.750 | 5 | 0.625 | 1,308.2 | 2,697.5 | 48.5% |
| 10 | 4/25/2017 | Nat | 69.8 | [illegible] | 10 | 10 | 49 | 17500 | 0.062 | 2 | 4 | 0.750 | 5 | 0.625 | 1,373.6 | 2,838.9 | 48.4% |
| 46 | 5/11/2017 | Nat | 66.4 | [illegible] | 13 | 14 | 48 | 19000 | 0.078 | H | 4 | 0.750 | 4.5 | 0.625 | 1,973.3 | 4,079.7 | 48.4% |

FIG. 16

TABLE 2

| Burner | Grate | Efficiency | Heating Time | Gas Used (Btu) | Input Rate (Btu/hr) |
|---|---|---|---|---|---|
| Existing | Existing (1.8") | 34.03% | 14 min, 24 sec | 7,735 | 32,235 |
| VT-A | Experimental (1") | 38.85% | 20 min, 13 sec | 6,784 | 20,238 |
| VT-A | Experimental (0.625") | 42.78% | 18 min, 17 sec | 6,146 | 20,177 |
| VT-B | Experimental (0.625") | 41.99% | 18 min, 34 sec | 6,290 | 20,334 |

TIERED BURNER

CROSS-REFERENCE TO RELATED APPLICATIONS

This application claims the benefit of U.S. Provisional Application No. 62/453,463, filed Feb. 1, 2017, which is hereby incorporated by reference, to the extent that it is not conflicting with the present application.

BACKGROUND OF INVENTION

1. Field of the Invention

The invention relates generally to commercial and residential cooking devices, and more specifically to gas burners.

2. Description of the Related Art

Traditional gas burners utilize flames for heating of cooking utensils, but often, much of the heat and energy is lost to dissipation when the flames are underneath a cooking utensil and make contact with it. Since the flames are not contained underneath the cooking utensil, much of the heat can escape around and away from the utensil being heated. This results in an inefficient and long cooking process, and can also result in wasted resources and energy. Thus, there is a need for a more efficient method of heating cooking utensils, and for better heat transfer.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an aspect a tiered burner head is combined with flame impinging vanes, such that heat is trapped beneath the cooking surface. The conical shape may help to reduce the amount of heat waste, and improve the speed of heating the cooking surface with radiant heat emission, and the design of the tiered burner head with flame impinging vanes may provide convection and radiation heating transfer. The burner is designed in such a manner that the hot combustion gases may be contained in a space beneath the cooking surface to allow for increase cooking efficiency. This may be accomplished as the hot gases are forced upwards towards the heated surface and the velocity of the hot combustion gases are slowed down to allow for greater heat absorption into the cooking utensil. The conical design of the burner may contain the hot gas flow to a pattern that minimizes heat loss around the heated surface or cooking utensil and improve the cooking efficiency. The burner may be provided with a series of two or more vanes proximate to the burner ports and provide additional heating effect to the heated surface, and the vanes may provide an infrared surface to transmit heat. Thus, an advantage is that less heat is lost than with a traditional gas burner, and the speed of heating to the cooking surface is also improved. Another advantage may be that the cooking-energy efficiency of the tiered burner is an improvement over existing burner configurations. Another advantage may be that less energy may be needed to heat a cooking vessel with the tiered vessel than with existing burners.

The tiered burner may also be constructed to function using a low pressure venture base which can allow the VT burner head to be adapted to an existing venture. Thus, an advantage may be that the tiered burner may be used for commercial or residential purposes and be adaptable and be able to be used with existing ventures.

In another aspect, a tiered burner is provided, comprising: a chamber defining a hollow interior space having a circular shape and a first volume, the circular chamber having an outer wall and an inner wall; a plurality of vanes in a tiered arrangement, each vane of the plurality of vanes having: an outer edge connected to the inner wall; and an inner edge, each inner edge extending from the inner wall; a plurality of rows of burner ports along the inner wall, each row of burner ports being underneath each inner edge, such that flames emitted from the row of burner ports is impinged from above by the inner edge and thus directed towards a center of the chamber, and wherein each vane of the plurality of vanes is configured to be heated to become red-hot and emit infrared radiation; a row of outer burner ports along the outer wall; wherein the plurality of vanes comprises: a first lowermost vane having a first diameter, and wherein the inner edge of the first lowermost vane is closest to the center of the chamber; a second vane above the first lowermost vane and having a second diameter, the inner edge of the second vane overhanging the outer edge of the first lowermost vane; a third vane above the second vane and having a third diameter, the inner edge of the third vane overhanging the outer edge of the second vane; a fourth uppermost vane having a fourth diameter, the inner edge of the fourth uppermost vane overhanging the outer edge of the third vane; an outer vane substantially aligned with the fourth uppermost vane, the outer vane extending outwards from the outer wall and over the row of outer burner ports such that flames emitted from the row of outer burner ports is impinged from above and directed away from the center of the chamber and causes a transfer of infrared radiation to the fourth uppermost vane; and wherein the fourth diameter is larger than the third diameter, the third diameter is larger than the second diameter, and the second diameter is larger than the first diameter; a central cavity at the center of the chamber, the central cavity being defined by the plurality of vanes, and having a conical shape; and a Venturi tube in fluid communication with the hollow interior space, such that the Venturi tube delivers gas into the hollow interior space and thus through the burner ports and into the central cavity, the Venturi tube having: a first end connecting the Venturi tube to the chamber; a second end configured to receive the gas from the gas source, the second end having a shutter configured to be slidably opened to control an amount of the gas delivered to the chamber; a second volume smaller than the first volume; and a constricted midsection. Again, an advantage is that less heat is lost than with a traditional gas burner, and the speed of heating to the cooking surface is also improved. Another advantage may be that the cooking-energy efficiency of the tiered burner is an improvement over existing burner configurations. Another advantage may be that less energy may be needed to heat a cooking vessel with the tiered vessel than with existing burners.

In another aspect, a tiered burner is provided, comprising: a chamber defining a hollow interior space, the chamber having an outer wall and an inner wall; a plurality of vanes in a tiered arrangement, each vane of the plurality of vanes having an outer edge and an inner edge, each inner edge extending from the inner wall of the chamber; a plurality of rows of burner ports along the inner wall, each row of burner ports being underneath each inner edge, such that flames emitted from the row of burner ports is impinged from above by the inner edge and thus directed towards a center of the plurality of vanes; a row of outer burner ports along the outer wall; an outer vane substantially aligned with an uppermost vane of the plurality of vanes, the outer vane extending outwards from the outer wall and over the row of outer burner ports such that flames emitted from the row of outer burner ports is impinged from above and causes a transfer of heat to the uppermost vane of the plurality of vanes; a central cavity at the center of and defined by the plurality of vanes, wherein a bottom end of the plurality of vanes has a first size, and a top end of the plurality of vanes a second size greater than the first size; and a Venturi tube in fluid communication with the hollow interior space, such that the Venturi tube delivers gas into the hollow interior space and thus through the burner ports and into the central cavity, the Venturi tube having: a first end connecting the Venturi tube to the chamber; a second end configured to receive the gas from the gas source; and a constricted midsection, such that the gas is subjected to a Venturi effect within the Venturi tube. Again, an advantage is that less heat is lost than with a traditional gas burner, and the speed of heating to the cooking surface is also improved. Another advantage may be that the cooking-energy efficiency of the tiered burner is an improvement over existing burner configurations. Another advantage may be that less energy may be needed to heat a cooking vessel with the tiered vessel than with existing burners.

In another aspect, a tiered burner is provided, comprising: a chamber; a plurality of vanes; a plurality of rows of burner ports; a Venturi tube in fluid communication with and connected to the chamber, and the chamber further being in fluid communication with the rows of burner ports; the chamber having an outer wall and an inner wall; the plurality of vanes having a tiered arrangement; each vane of the plurality of vanes having an inner edge extending from the inner wall towards a center of the plurality of vanes, and extending above a row of burner ports of the plurality of rows of burner ports, such that flames emitted from the row of burner ports is impinged from above by the inner edge and thus directed towards the center of the plurality of vanes; and the Venturi tube having: a constricted midsection; a first end creating a connection to the chamber; and a second end configured to receive gas from a gas source. Again, an advantage is that less heat is lost than with a traditional gas burner, and the speed of heating to the cooking surface is also improved. Another advantage may be that the cooking-energy efficiency of the tiered burner is an improvement over existing burner configurations. Another advantage may be that less energy may be needed to heat a cooking vessel with the tiered vessel than with existing burners.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which:

FIG. 16 shows Table 1 summarizing the results and observations of tests conducted using various tiered burners.

DETAILED DESCRIPTION

Figure 1:
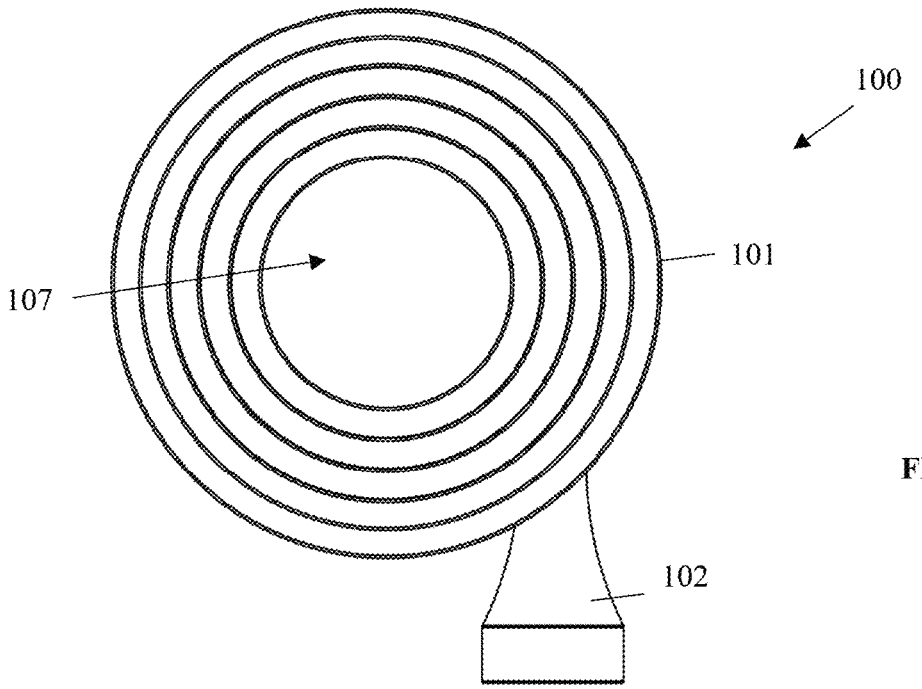
FIG. 1 illustrates the top view of a tiered burner, according to an aspect.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

It should be understood that, for clarity of the drawings and of the specification, some or all details about some structural components or steps that are known in the art are not shown or described if they are not necessary for the invention to be understood by one of ordinary skills in the art.

For the following description, it can be assumed that most correspondingly labeled elements across the figures (e.g., 107 and 207, etc.) possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

FIG. 1 illustrates the top view of a tiered burner 100, according to an aspect. The tiered burner 100 may be conical in shape, and may include a chamber, which may be a cone portion ("chamber," "burner head," or "cone portion") 101, having a hollow interior and a center cavity ("center cavity," or "central cavity") 107 defined by the inner side or wall of the chamber, from within which heat may be delivered to the underside of any surface for cooking, such as any type of cooking vessel which may be placed on top of the tiered burner 100. The tiered burner 100 may also be provided with a Venturi tube 102 for allowing the connection of the tiered burner 100 to a gas control valve, for example, or any other suitable gas source.

Figure 2:
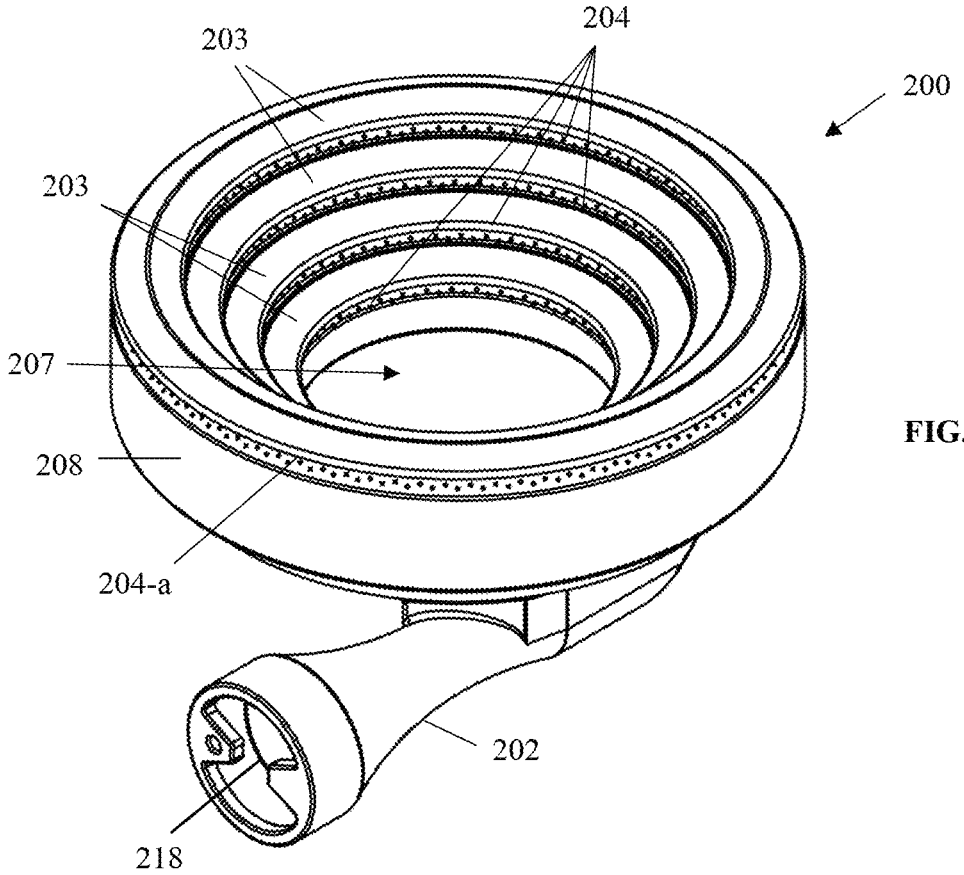
FIG. 2 illustrates the perspective view of a tiered burner, according to an aspect.

FIG. 2 illustrates the perspective view of a tiered burner 200, according to an aspect. The tiered burner 200 may have at least two impinging vanes ("impinging vanes," "vanes," or "fins") 203. As shown as an example, a tiered burner 200 may include four impinging vanes 203. The vanes 203 may each be circular, and may be arranged in layered tiers, with the lowermost vane having the smallest diameter and circumference, and the uppermost vane having the largest diameter and circumference. The vanes may thus be arranged such that each circular vane has an inner edge and an outer edge (as will be discussed further when referring to FIG. 8) and a vane's inner edge may be substantially aligned with and hanging over the outer edge of the vane below it. The tiers of vanes may form an inverted cone-shaped hollow interior, or center cavity 207. Each impinging vane 203 may be placed along the cavity 207 such that an overhanging tier is positioned over a row of burner ports 204, providing a tiered structure or shingled effect. A row of outer burner ports 204-*a* may also be provided along the outer surface ("outer surface," or "exterior") 208 of the tiered burner 200. As an example, the tiered burner 200 may be circular as shown, or the layers of impinging vanes may be arranged in a rectangular shape, or any other suitable shape. The vanes 203 may be solid as shown as an example, or may each be ribbed with separated breaks between sections of ribs.

According to the Venturi Effect, a gas moving through a space such as from a narrow tube to a wider tube accelerates in the narrow portion, causing a decrease in pressure. The gas accelerates and decreases in pressure when at the wider portion of the tube. The Venturi tube 202 may be provided with a thinner or constricted midsection such that gas flowing towards the tiered burner 200 flows through a constricted portion to speed up, and drop in pressure. Additionally, the plurality of burner ports 204 provided in the tiered burner 200 may be equivalent to a larger, much wider tube than the overall narrower Venturi tube 202, and the velocity of the hot combustion gases are slowed down when exiting the burner ports 204, where the gases are ignited and thus from which flames are emitted, for heating a cooking utensil. Thus, this effect may allow for greater heat absorption into the cooking utensil. The Venturi tube 202 may also be provided with a shutter 218, which may be opened or closed, or be partially open, and allow a user to control the amount of gas that is provided into the Venturi tube 202.

Figure 3:
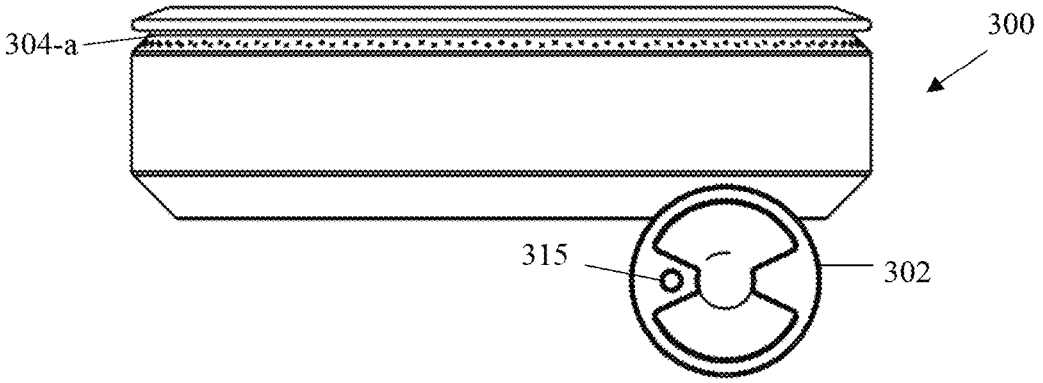
FIG. 3 illustrates the rear elevation view of a tiered burner, according to an aspect.

FIG. 3 illustrates the rear elevation view of a tiered burner 300, according to an aspect. The venturi tube 302 may include any suitable attachment means 315 for attaching the tiered burner 300 to a gas valve. As shown as an example, a hole 315 for a screw may be provided. A row of outer burner ports 304-*a* may also be visible in this view.

Figure 4:
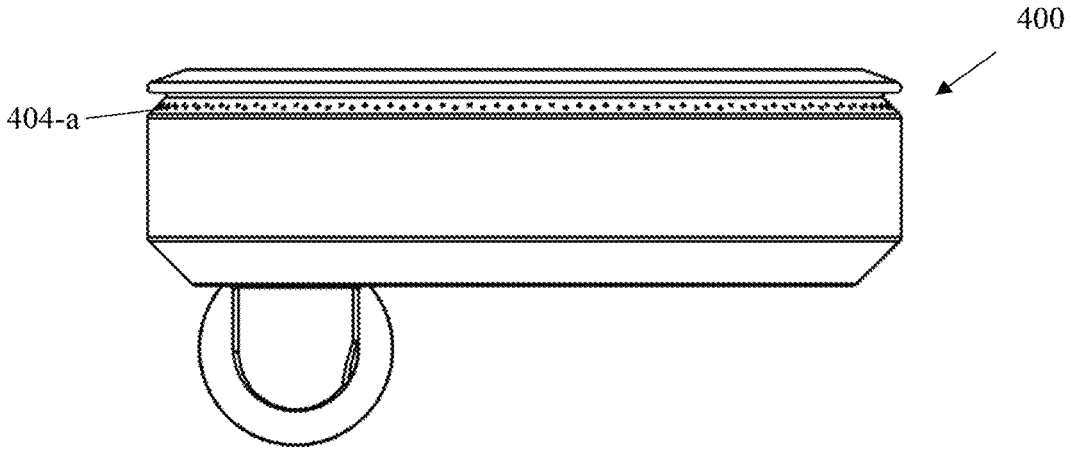
FIG. 4 illustrates the front elevation view of a tiered burner, according to an aspect.

FIG. 4 illustrates the front elevation view of a tiered burner 400, according to an aspect. Again, a row of outer burner ports 404-*a* may also be visible in this view.

Figure 5:
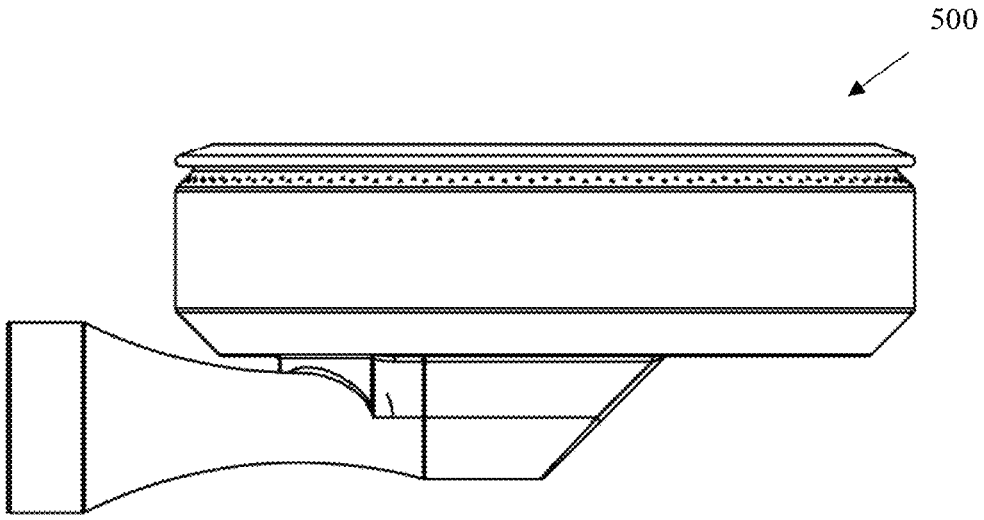
FIG. 5 illustrates the left side elevation view of a tiered burner, according to an aspect.

FIG. 5 illustrates the left side elevation view of a tiered burner 500, according to an aspect.

Figure 6:
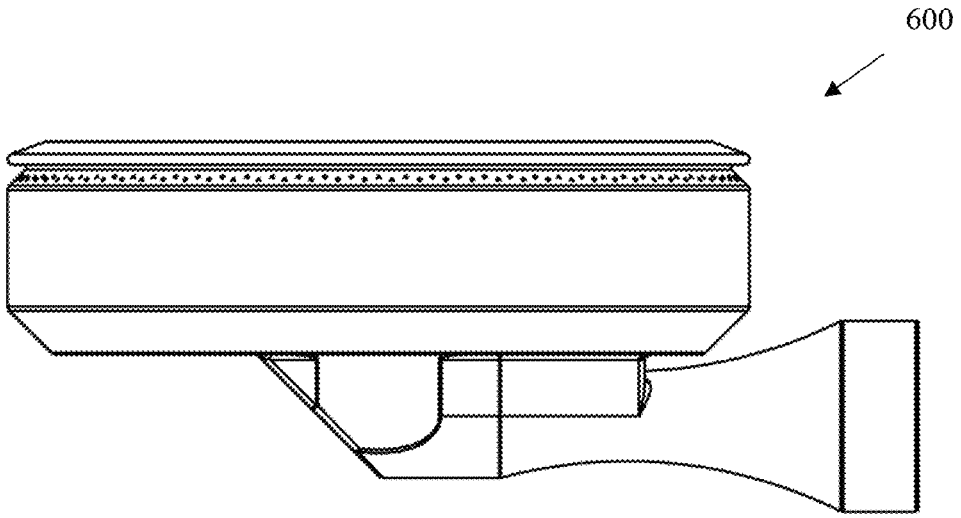
FIG. 6 illustrates the right side elevation view of a tiered burner, according to an aspect.

FIG. 6 illustrates the right side elevation view of a tiered burner 600, according to an aspect.

Figure 7:
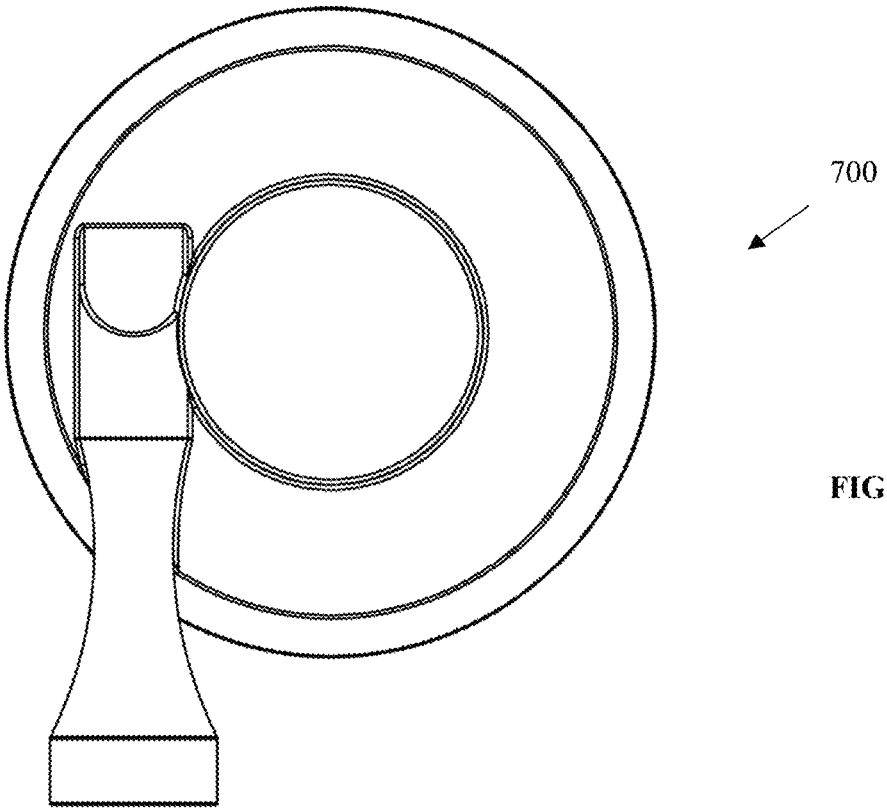
FIG. 7 illustrates the bottom plan view of a tiered burner, according to an aspect.

FIG. 7 illustrates the bottom plan view of a tiered burner 700, according to an aspect.

Figure 8:
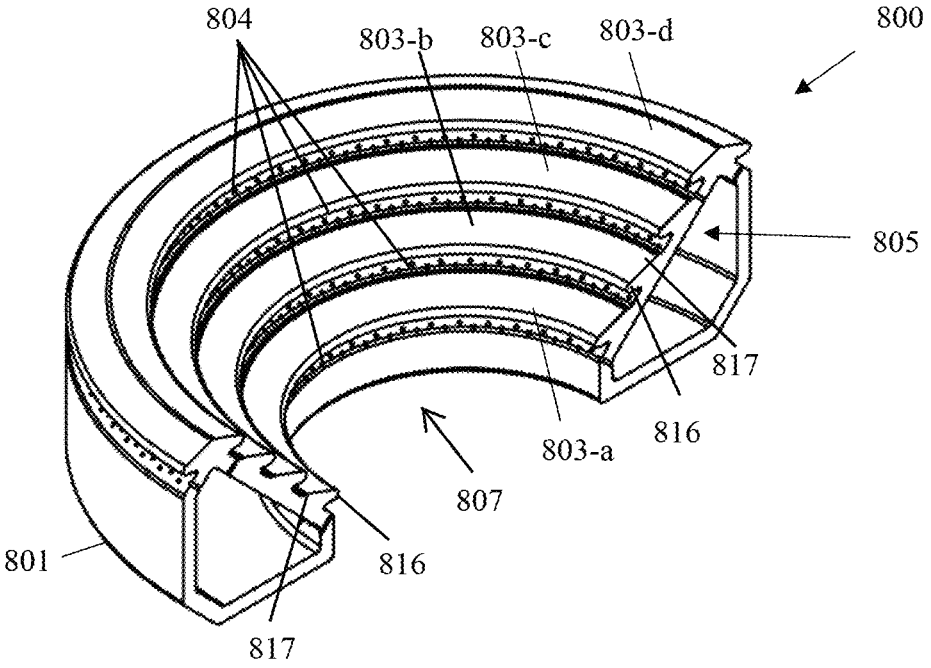
FIG. 8 illustrates the perspective cutaway view of the chamber of a tiered burner, according to an aspect.

FIG. 8 illustrates the perspective cutaway view of the chamber 801 of a tiered burner 800, according to an aspect. The cone 801 may be provided with a hollow interior space 805, in which gases and air may be mixed and ignited for combustion. Again, as discussed when referring to FIG. 2, the cone 801 may be provided with a plurality of impinging vanes. As shown as an example, the cone may include four vanes referred to as 803-*a* through 803-*d* from the lowermost vane to the uppermost vane. As shown in FIG. 2, each vane may be circular (shown as a partial circular shape in FIG. 8). Again, the vanes may be arranged in layered tiers, with the lowermost vane having the smallest diameter and circumference, and the uppermost vane having the largest diameter and circumference. Each vane may have an inner edge 816, and an outer edge 817. As an example, the inner edge 816 lowermost vane 803-*a* may be the innermost section of the central cavity 807. The inner edge 816 of the next vane 803-*b* above may be substantially aligned with and hang over the outer edge 817 of the lowermost vane 803-*a*, and so on. Thus, the four vanes 803-*a* through 803-*d* may be arranged such that the tiers of vanes may be shingled, and form an inverted cone-shaped hollow interior, or central cavity 807. Each impinging vane 203 may be placed along the cavity 207. Again, each vane may be provided with a row of burner ports 804.

Figure 9:
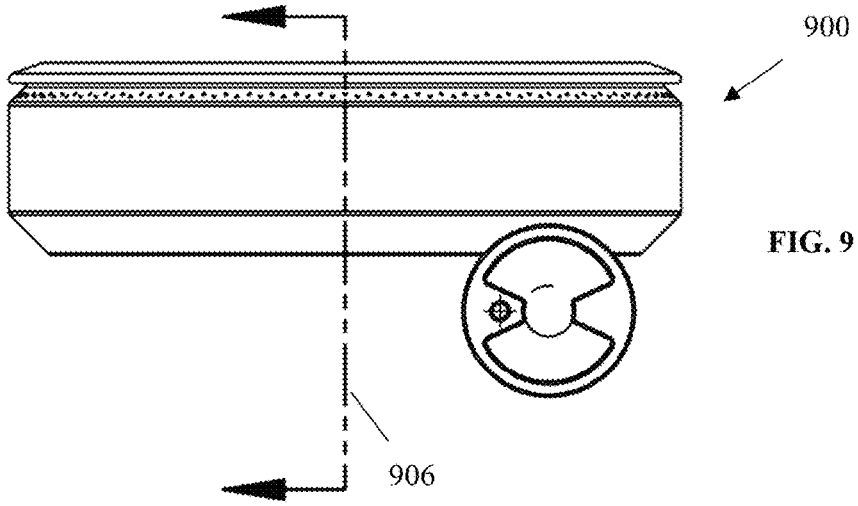
FIG. 9 illustrates the rear elevation view of a tiered burner, with a line showing the plane of the sectional view of FIG. 10, according to an aspect.
Figure 10:
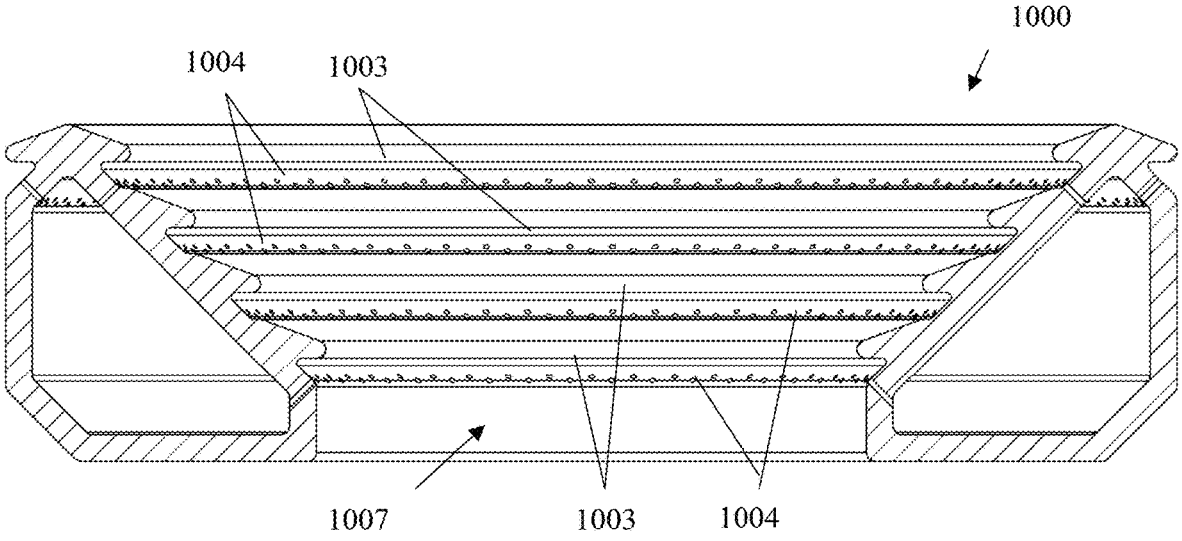
FIG. 10 illustrates the side sectional view of a tiered burner, along the line of FIG. 9, according to an aspect.

FIG. 9 illustrates the rear elevation view of a tiered burner 900, with a line 906 showing the plane of the sectional view shown in FIG. 10, according to an aspect.

FIG. 10 illustrates the side sectional view of a tiered burner 1000, along the line 906 of FIG. 9 looking into the direction of the arrows, according to an aspect. As shown as an example, a tiered burner 1000 may be provided with four rows of burner ports 1004 along the cavity 1007, and each row of burner ports 1004 may have an impinging vane 1003 positioned above it. As an example, each vane may be angled downwards at an angle less than 90 degrees with respect to a bottom surface of the tiered burner, further assisting the impinging effect of the vanes on the flames emitted by the burner ports 1004.

Figure 11:
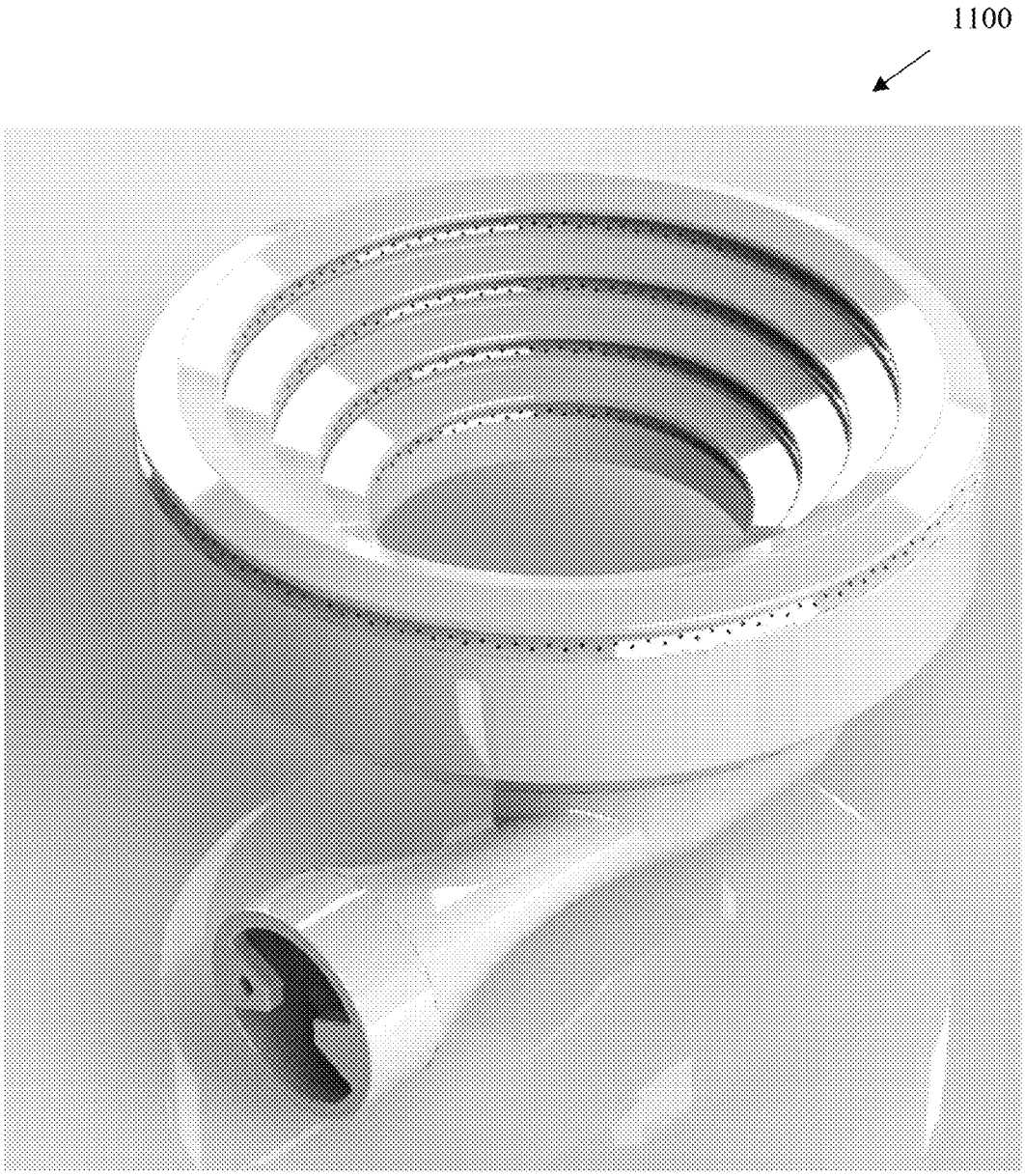
FIG. 11 illustrates the perspective view of another example of a tiered burner, according to an aspect.

FIG. 11 illustrates the perspective view of another example of a tiered burner 1100, according to an aspect.

Figure 12:
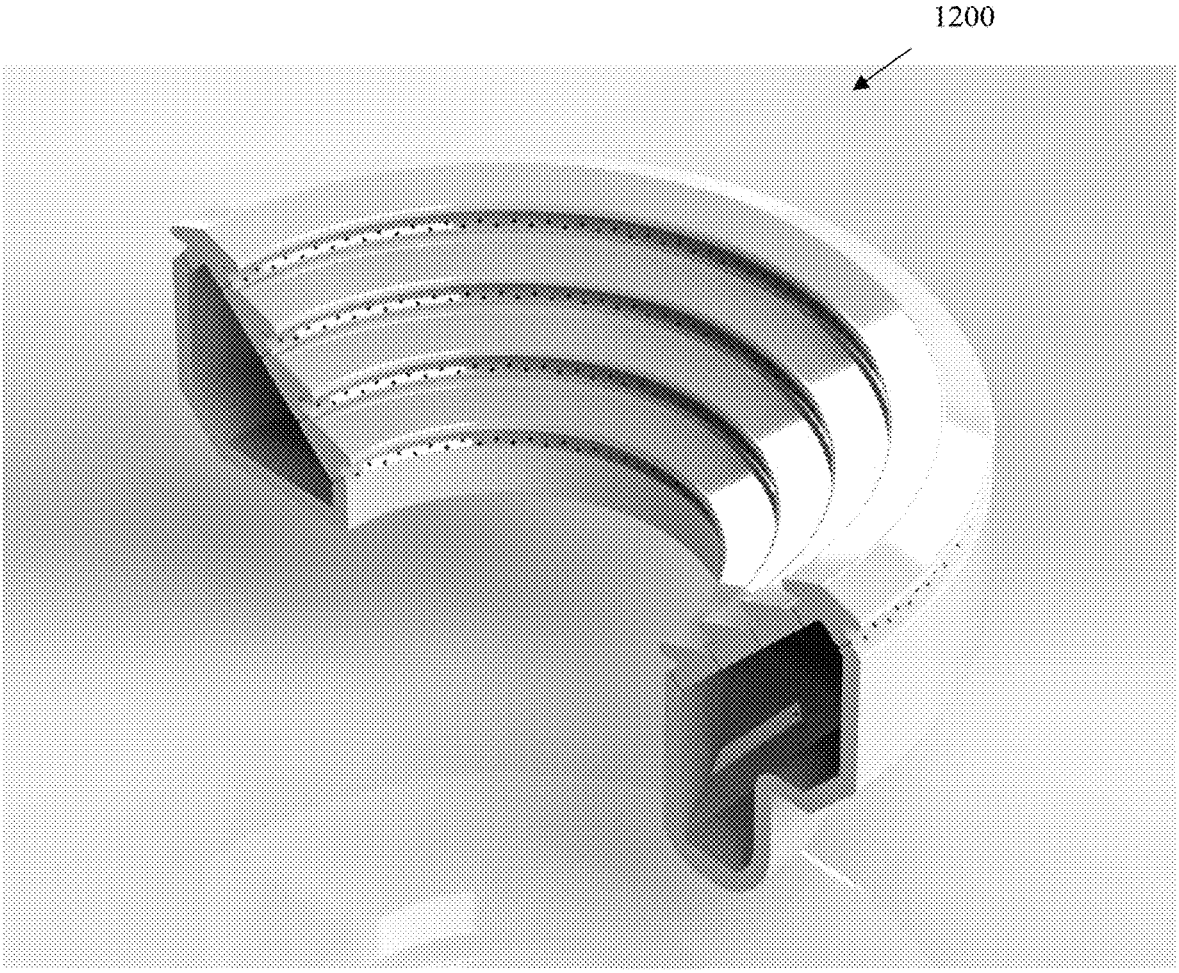
FIG. 12 illustrates the perspective cutaway view of another example of the cone portion of a tiered burner, according to an aspect.

FIG. 12 illustrates the perspective cutaway view of another example of the cone portion of the tiered burner 1200 of FIG. 11, according to an aspect.

Figure 13:
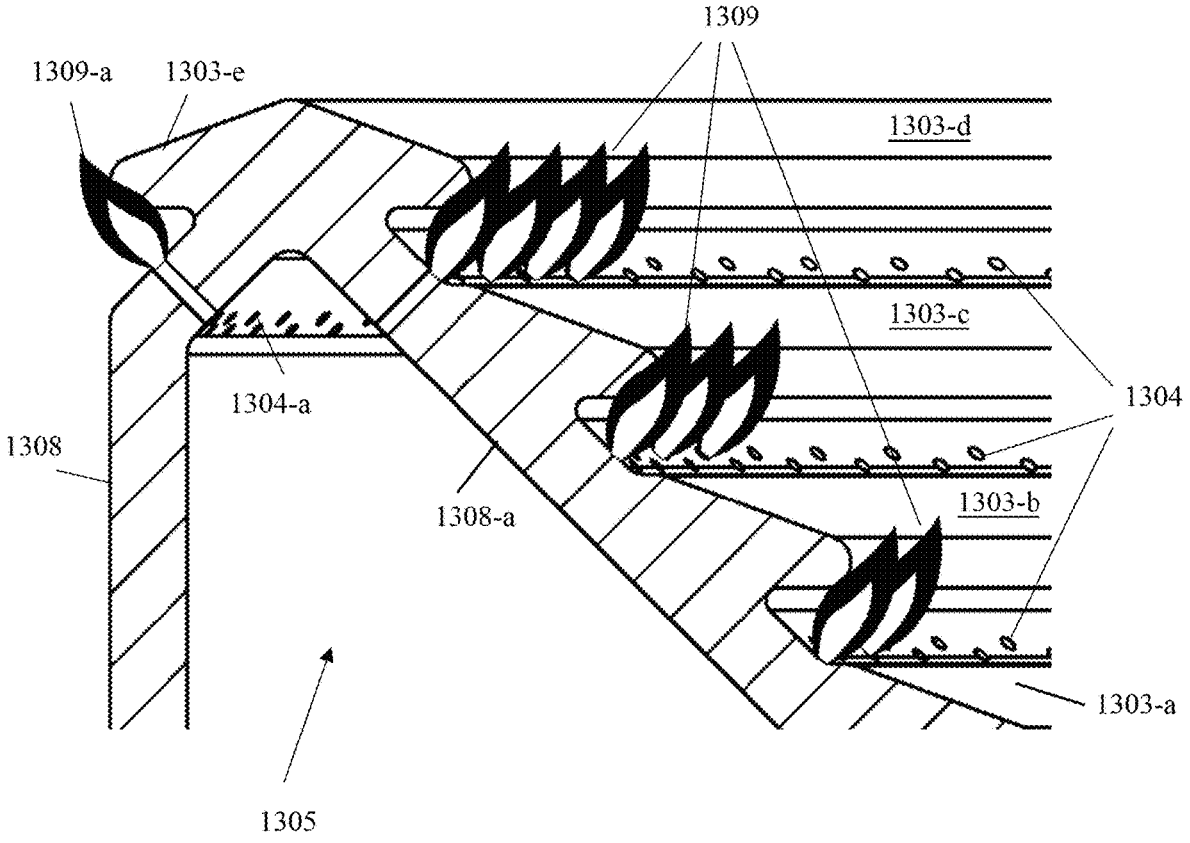
FIG. 13 illustrates the partial side perspective sectional view of the impinging vanes and flames of a tiered burner in use, according to an aspect.

FIG. 13 illustrates the partial side perspective sectional view of the impinging vanes 1303 and flames 1309 of a tiered burner in use, according to an aspect. Flames 1309, from the burner ports (shown only from a front section of burner ports for visual clarity), may be positioned in rows underneath each impinging vane 1303. The overhang of the vanes 1303-*a* through 1303-*d* over the burner ports may cause an impinging effect on the flames 1309. Thus, the flames 1309 may be caused to be directed inwards towards the central cavity of the tiered burner, more so than upwards. The flames 1309 may also heat the overhanging impinging vanes 1303-*a* through 1303-*d* themselves to increase the heat and rate of heat transfer to the cooking surface, as the impinging vanes 1303 become heated infrared surfaces, and become red-hot to transfer radiation heat to a cooking vessel. A row of exterior burner ports 1304-*a* (visible from the interior hollow portion 1305 of the sectional view) and flames from the burner ports ("outer flames" or "afterburners") 1309-*a* may also be provided along the outer surface or wall 1308 of the tiered burner. The flames 1309-*a* from the exterior side or outer wall 1308 of the tiered burner may also be directed out at an angle due to an outer or exterior vane 1303-*e*. The outer flames 1309-*a* being directed at an angle directly underneath the overhanging outer edge of each vane may heat the exterior impinging vane 1303-*e*. When the exterior impinging vane 1303-*e* is heated, this may cause the uppermost impinging vane 1303-*d* on the interior of the tiered burner to become heated and may become heated and deliver infrared heat. Similarly, when the impinging vanes 1303-*b* through 1303-*e* are heated, this may cause the vanes 1303-*b* through 1301-*d* of the tiered burner to become heated and may become red-hot and deliver infrared heat.

Since the uppermost impinging vane 1303-*d* may be more susceptible to heat loss than the lower impinging vanes 1303-*a* through 1303-*c*, the heat from the exterior vane 1303-*e* may help to maintain the heat of the uppermost vane 1303-*d*. The cavity of the tiered burner, as seen in FIG. 2, may contain the hot gas flow and may minimize heat loss around the surface of the utensil used for cooking, which may help to improve cooking efficiency and reduce waste of gases. The containment of the hot combustion gases within the cavity and trapping of heat underneath the cooking surface, and the direction of heat upwards towards to the cooking surface may be achieved by the impinging vanes 1303-*a* through 1303-*d*, the physical shape of the tiered burner, the flames, and the Venturi Effect. The impinging vanes 1303-*a* through 1303-*d* may direct the flames 1309 and heat inwards and upwards at an angle, and may trap the heat by the layered or tiered structure. The physical conical shape of the burner, as well as the wall of radiation created by the flames 1309 along the cavity may also assist in containment of the gases and heat. Lastly, the lowered velocity of the hot combustion gases by the Venturi Effect may also contribute to the containment of heat and improved heating of a cooking surface, caused by the creation of a larger tube area from the sum of all the burner ports 1304 as compared to the Venturi tube (shown by 202 in FIG. 2) from which the gas enters the burner.

The bottom surface of each vane may be flat or parallel with respect to a top or bottom surface of the tiered burner. The top surface of each vane may be at an angle, and may be sloped downwards. As an example, the top surface may be sloped downwards at an angle, such as, for example, 30 degrees with respect to the top surface of the burner. This may help the heat generated by the burner to radiate upwards and inwards towards the center of the burner. As another example, the top surface of each vane may be any angle less than 90 degrees less with respect to the top surface of the burner.

As an example, the outer wall 1308 may be perpendicular with respect to a bottom surface of the tiered burner. The inner wall 1308-*a* may be at an angle angled towards the center of the burner. As an example, the angle may be 45 degrees or 50 degrees.

Figure 14A:
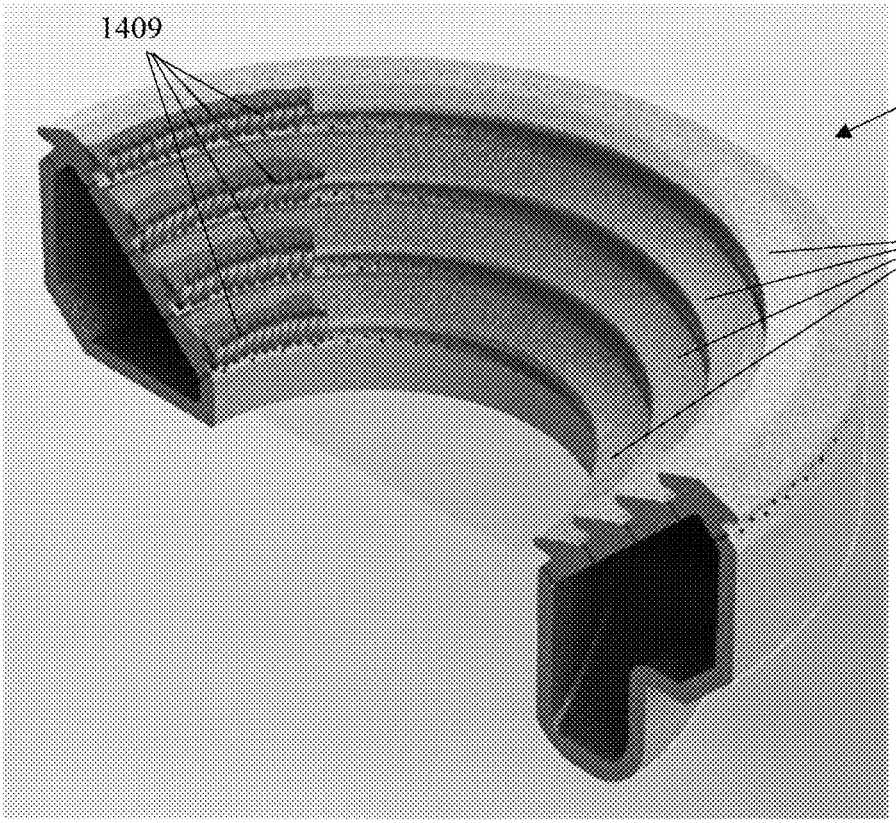
FIG. 14A illustrates the perspective cutaway view of another example of the cone portion of a tiered burner in use, according to an aspect.

FIG. 14A illustrates the perspective cutaway view of another example of the cone portion of a tiered burner 1400 in use, according to an aspect. Flames 1409 may be directed inwards from burner ports, as shown (small section of flames shown only on the left side of the cutaway for visual clarity).

Figure 14B:
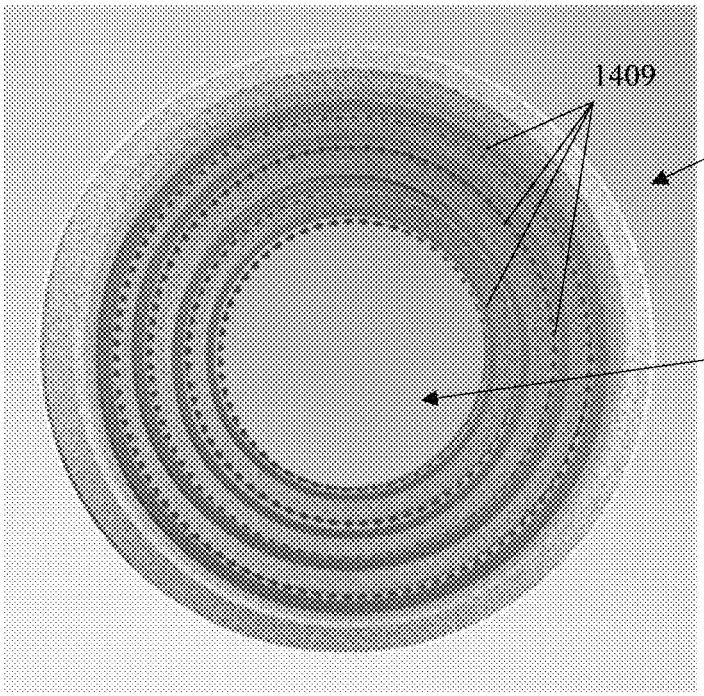
FIG. 14B illustrates the top plan view of another example of a tiered burner in use, according to an aspect.

FIG. 14B illustrates the top plan view of another example of a tiered burner 1400 in use, according to an aspect. As shown as an example, a tiered burner 1400 may have four rows of burner ports for four rows of flames 1409. When the tiered burner 1400 is turned on and in use, the cavity 1407 may be filled with hot gas, and the edges of the impinging vanes 1403 may become superheated from the flames 1409, being positioned directly over each row of flames (as shown in FIG. 14A).

Figure 15A:
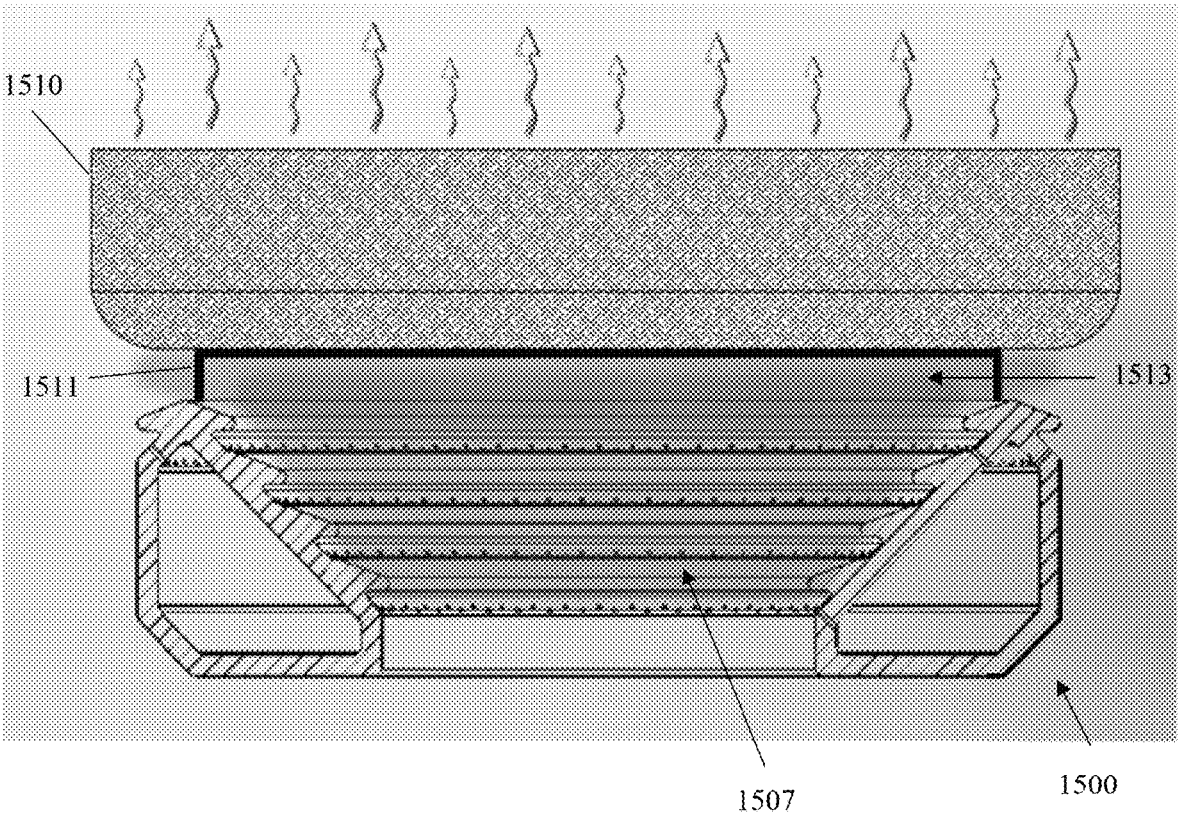
FIG. 15A illustrates the side sectional view of a tiered burner in use with a cooking utensil, according to an aspect.

FIG. 15A illustrates the side sectional view of a tiered burner 1500 in use with a cooking utensil 1510, according to an aspect. A cooking utensil 1510, such as, for example, a pot, pan, or any other suitable utensil, may be used for cooking by having heat provided by the hot combustion gases contained in the cone-shaped cavity 1507 underneath the cooking utensil 1510. As the combustion process takes place and gas continues to enter the combustion area of the cavity 1507, the gases may be vented such that a small amount may be allowed to escape the combustion area. A grate, grill, tray, or any other suitable support 1511 (hereinafter "support") may be used in association with the tiered burner 1500, such that an air gap 1513 is provided between the tiered burner 1500 and the cooking utensil 1510, thus creating a vent means for the gases.

Figure 15B:
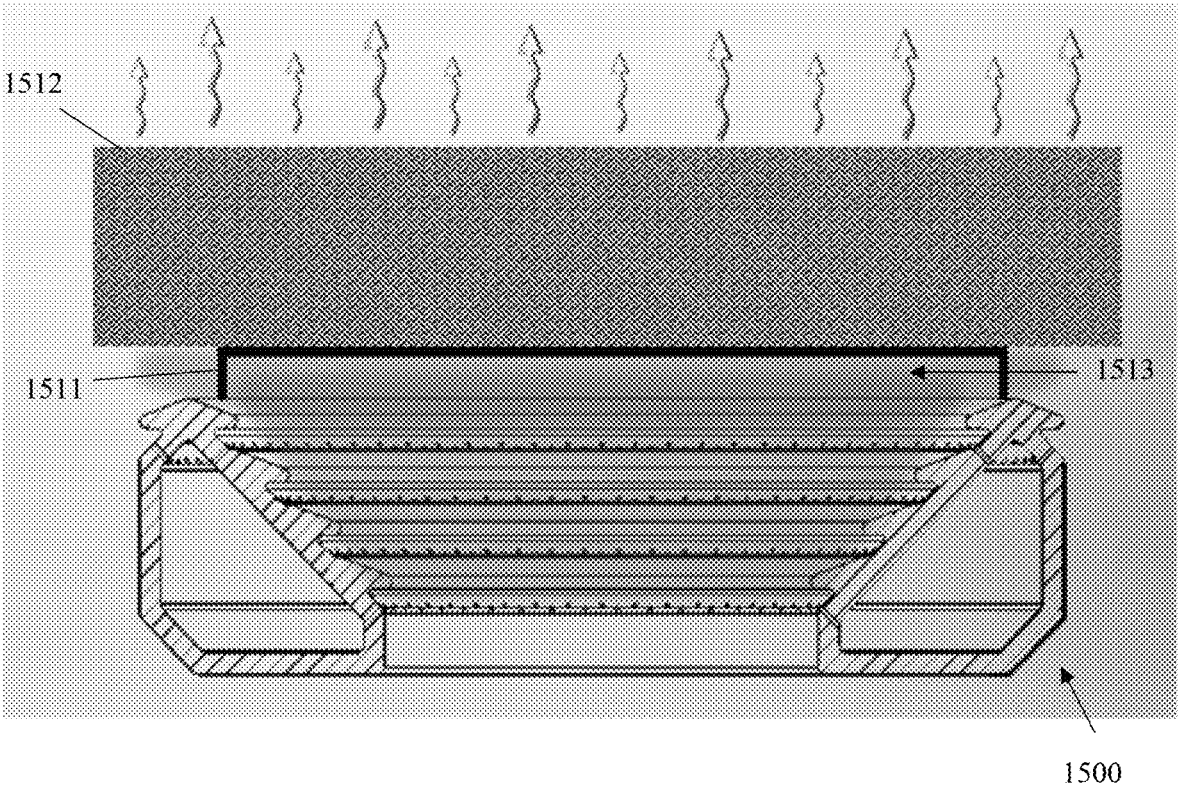
FIG. 15B illustrates the side section view of another example of a tiered burner in use with a hot plate, according to an aspect.

FIG. 15B illustrates the side sectional view of another example of a tiered burner 1500 in use with a hot plate 1512, according to an aspect. As an example, a hot plate or griddle 1512 or any other suitable heating means may be used in association with the tiered burner 1500. The hot plate 1512 may be placed above the burner 1500 by any support 1511, such as a grill or grate in order to, again, create an air gap 1513 for gas exhaust or venting. Any suitable cooking utensil such as a pot, pan, plate or food product may then be placed on top of the hot plate 1512 for cooking.

FIG. 16 shows Table 1 summarizing the results and observations of tests conducted using various tiered burners. Of 74 tests conducted, the tests showing the top 30 efficiencies are shown. Appliance cooking-energy efficiency is a measure of how much of the energy consumed by an appliance is actually delivered to the food product during the cooking process. The methods developed and used by ASTM International for measuring cooking appliance energy efficiency have been based on this definition, and the following equations, where the cooking-energy efficiency quantity of energy imparted to a specified food product is expressed as a percentage of energy consumed by the appliance during the cooking event, where $\eta$=cooking-energy efficiency $E_{appliance}$=energy into the appliance $E_{food}$=energy to the food product $E_{sens}+E_{thaw}+E_{evap}$, where $E_{sens}$=quantity of heat added to the food product, which causes its temperature to increase from the starting temperature to the average bulk temperature of a "done" food product $W_i \times C_p \times (T_f - T_i)$, where $W_i$=initial weight of the food product in pounds (lb)

$C_p$=specific heat of the foot product, in British thermal unit (BTU) per pound (BTU/lb), expressed as degrees Fahrenheit (° F.)

$T_f$=final cooked temperature of the food product, in ° F.

$T_i$=initial internal temperature of the food product, in ° F.

$E_{thaw}$=latent heat of fusion added to the food product, which causes the moisture (in the form of ice) contained in the food product to melt when the temperature of the food product reaches 32° F.

$\times W_{iw} H_f$ where $W_{iw}$=initial weight of water in the food product in lb $H_f$=heat of fusion in BTU/lb, and where 144 BTU/lb at 32° F.

$E_{evap}$=latent heat (of vaporization) added to the food product, which causes some of the moisture contained in the food product to evaporate $\times W_{loss} H_v$ where $W_{loss}$=weight loss of water during cooking, in lb $H_v$=heat of vaporization, in BTU/lb, and where 970 BTU/lb is at 212° F.

Using the above equations, and experimental procedures described by the ASTM Test Methods, Food Service Technology Center (FSTC) performed studies to find various appliance energy efficiencies. Standard efficiency range tops, which are the widely or commonly available type of range tops, were found to have an efficiency of 25-35%. Referring to Table 1, the 30 test runs using various types of tiered burners showed higher efficiencies that standard efficiency range tops, showing efficiencies from approximately 48.4% to approximately 62.3%.

Figures 17, 18:
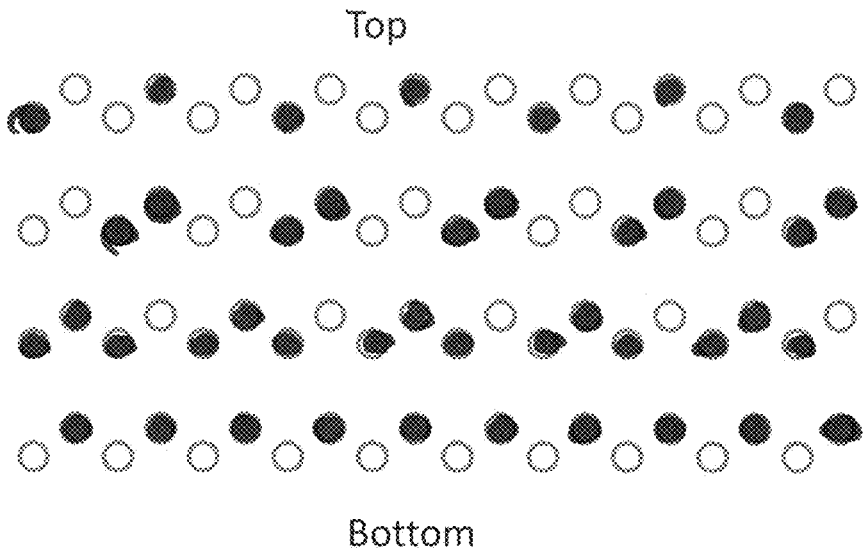
FIG. 17 illustrates an example of a burner port configuration used in a number of the tests conducted and summarized in Table 1 of FIG. 16, according to an aspect.
FIG. 18 shows Table 2 summarizing the results and observations of additional tests conducted using an existing burner compared with using two types of tiered burners VT-A and VT-B.

Various tiered burners were tested by placing a grate on top of the tiered burner and noting the grate height, using either natural gas or liquefied petroleum (LP), standard pot sizes of either 10 or 13 inches, various pounds of water, and various configurations of burner ports (each receiving a letter designation, an example of which is shown in FIG. 17). Another variable noted in the study is the amount of the shutter opening as a percent of the total opening of the shutter shown by 218 in FIG. 2.

As can be seen from the results shown in Table 1, the tiered burners are able to produce a much higher cooking-energy efficiency than that of standard or commonly available range tops. In addition, FIG. 17 illustrates an example of a burner port configuration used in a number of the tests conducted and summarized in Table 1 of FIG. 16, according to an aspect. Configuration F is shown in FIG. 17 as an example, where filled circles represent existing burner ports and empty circles represent no burner ports being present. A tiered burner may use any suitable configuration of burner ports.

FIG. 18 shows Table 2 summarizing the results and observations of additional tests conducted using an existing burner compared with using two types of tiered burners VT-A and VT-B. VT-A and VT-B are similar tiered burners with different burner port configurations, and two grate heights were tested for VT-A. The two tested tiered burners VT-A and VT-B, despite showing an increased heating time as compared to the existing burner, were able to greatly reduce the amount of input energy needed to heat a food product to 200° F. as well as reduce the amount of lost energy. For the existing burner, an input rate of 32,235 BTU per hour was required. For the first experiment using VT-A, an input rate of only 20,238 BTU/hour was required. Thus, a lower energy input rate was required; additionally, less energy consumption was needed (7,735 BTU as compared with the 6,784 BTU required by the VT-A), showing that the tiered burner is a much more energy efficient burner.

It should be understood that the tiered burner may be constructed of cast iron, metal, or any other suitable material for efficient transfer of heat to a cooking surface.

It should also be understood that while the focus in the disclosure is on the configuration of the tiered burner with the smallest diameter vane at the bottom and the largest diameter vane at the top, thus with a narrower portion of the central cavity at the bottom and a wider portion of the central cavity at the top, as an example, the tiered burner may also be constructed in an alternative embodiment having the narrower portion of the central cavity at the top and the wider portion of the central cavity at the bottom.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. As used in this application, "and/or" means that the listed items are alternatives, but the alternatives also include any combination of the listed items.

The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. The terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases.

Throughout this description, the aspects, embodiments or examples shown should be considered as exemplars, rather than limitations on the apparatus or procedures disclosed or claimed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

What is claimed is:

1. A tiered burner, comprising:

a chamber defining a hollow interior space having a circular shape and a first volume, the circular chamber having an outer wall and an inner wall, towards a central cavity;

a plurality of vanes in a tiered arrangement, each vane of the plurality of vanes having:

an outer edge connected to the inner wall; and an inner edge, each inner edge extending radially away from the inner wall;

a plurality of rows of burner ports along the inner wall, each row of burner ports being underneath each inner edge, and at a greater distance from a central axis of the central cavity than the inner edge, such that flames emitted from the row of burner ports is impinged from above by the inner edge and thus directed towards a center of the central cavity, and thus each vane of the plurality of vanes is configured to be heated to become red-hot and emit infrared radiation;

a row of outer burner ports along the outer wall;

wherein the plurality of vanes comprises:

a first lowermost vane having a first diameter, and wherein the inner edge of the first lowermost vane is closest to the center of the central cavity;

a second vane above the first lowermost vane and having a second diameter, the inner edge of the second vane overhanging the outer edge of the first lowermost vane;

a third vane above the second vane and having a third diameter, the inner edge of the third vane overhanging the outer edge of the second vane;

a fourth uppermost vane having a fourth diameter, the inner edge of the fourth uppermost vane overhanging the outer edge of the third vane;

an outer vane substantially aligned with the fourth uppermost vane, the outer vane extending outwards from the outer wall and over the row of outer burner ports such that flames emitted from the row of outer burner ports is impinged from above and directed away from the center of the chamber and causes a transfer of infrared radiation to the fourth uppermost vane; and wherein the fourth diameter is larger than the third diameter, the third diameter is larger than the second diameter, and the second diameter is larger than the first diameter;

the central cavity being defined by the plurality of vanes, such that the tiered arrangement of the plurality of vanes causes the central cavity to have a conical shape;

thereby the tiered arrangement of the plurality of vanes and staggering of the burner ports within each row of burner ports causes the flames in successive rows to avoid overlapping; and a Venturi tube in fluid communication with the hollow interior space, such that the Venturi tube delivers gas into the hollow interior space and thus through the burner ports and into the central cavity, the Venturi tube having:

a first end connecting the Venturi tube to the chamber;

a second end configured to receive the gas from the gas source, the second end having a shutter configured to be slidably opened to control an amount of the gas delivered to the chamber;

a second volume smaller than the first volume; and a constriction between the first end and the second end.

2. The tiered burner of claim 1, the second end of the Venturi tube further comprising a means for attaching the Venturi tube to the gas source.

3. The tiered burner of claim 1, wherein a top vane surface of each vane is angled downwards at an angle less than 90 degrees with respect to an upper surface of the tiered burner.

4. A tiered burner, comprising:

a chamber defining a hollow interior space, the chamber having an outer wall and an inner wall;

a plurality of vanes in a tiered arrangement, each vane of the plurality of vanes having an outer edge and an inner edge, each inner edge extending from the inner wall of the central cavity;

a plurality of rows of burner ports along the inner wall, each row of burner ports being underneath each inner edge, such that flames emitted from the row of burner ports is impinged from above by the inner edge and thus directed towards a center of the plurality of vanes;

thereby the tiered arrangement of the plurality of vanes and the staggering of the burner ports within each row of burner ports causes the flames in successive rows to avoid overlapping;

a row of outer burner ports along the outer wall;

an outer vane substantially aligned with an uppermost vane of the plurality of vanes, the outer vane extending outwards from the outer wall and over the row of outer burner ports such that flames emitted from the row of outer burner ports is impinged from above and causes a transfer of heat to the uppermost vane of the plurality of vanes;

a central cavity defined by the plurality of vanes, wherein a bottom end of the plurality of vanes has a first size, and a top end of the plurality of vanes a second size greater than the first size, such that the central cavity is conical; and a Venturi tube in fluid communication with the hollow interior space, such that the Venturi tube delivers gas into the hollow interior space and thus through the burner ports and into the central cavity, the Venturi tube having:

a first end connecting the Venturi tube to the chamber;

a second end configured to receive the gas from the gas source; and a constriction at a midpoint between the first end and the second end, such that the gas is subjected to a Venturi effect within the Venturi tube.

5. The tiered burner of claim 4, wherein each vane of the plurality of vanes is configured to be heated to emit infrared radiation.

6. The tiered burner of claim 4, wherein the plurality of vanes is four vanes.

7. The tiered burner of claim 4, the second end of the Venturi tube further comprising:

a means for attaching the Venturi tube to the gas source; and a shutter configured to be slidably opened to control an amount of the gas delivered to the chamber.

8. The tiered burner of claim 4, wherein a top vane surface of each vane is angled downwards at an angle less than 90 degrees with respect to an upper surface of the tiered burner.

9. The tiered burner of claim 4, wherein each burner port of each row of burner ports is arranged in a staggered formation, such that a top portion of the burner ports is aligned with a bottom side of an outer edge of a first vane, and a bottom portion of the burner ports is aligned with a top side of an inner edge of a second vane.

10. The tiered burner of claim 4, wherein the inner wall is sloped downwards towards the center of the plurality of vanes at a 45-50 degree angle with respect to a top surface of the tiered burner.

11. A tiered burner comprising:

a chamber;

a plurality of vanes;

a plurality of rows of burner ports;

a central cavity defined by the plurality of vanes, wherein a bottom end of the plurality of vanes has a first size, and a top end of the plurality of vanes a second size greater than the first size, such that the central cavity is conical;

a Venturi tube in fluid communication with and connected to the chamber, and the chamber further being in fluid communication with the rows of burner ports;

the chamber having an outer wall and an inner wall; the plurality of vanes having a tiered arrangement;

each vane of the plurality of vanes having an inner edge extending from the inner wall towards a center of the plurality of vanes, and extending above a row of burner ports of the plurality of rows of burner ports, such that the plurality of rows of burner ports and the plurality of vanes are disposed substantially along the inner wall, and such that flames emitted from the row of burner ports is impinged from above by the inner edge and thus directed towards the center of the plurality of vanes;

thereby the tiered arrangement of the plurality of vanes and staggering of the burner ports within each row of burner ports causes the flames in successive rows to avoid overlapping; and the Venturi tube having:

a first end creating a connection to the chamber;

a second end configured to receive gas from a gas source; and a constriction at a midpoint between the first end and the second end.

12. The tiered burner of claim 11, wherein a top vane surface of each vane is angled downwards at an angle less than 90 degrees with respect to an upper surface of the tiered burner, and wherein the inner wall is angled downwards and towards the center of the plurality of vanes.

13. The tiered burner of claim 11, wherein the chamber surrounds the burner ports.

14. The tiered burner of claim 11, wherein the burner ports are perforated in the inner wall of the chamber.

15. The tiered burner of claim 11, further comprising a row of outer burner ports perforated in the outer wall of the chamber and configured to cause a transfer of heat to an upper surface of the tiered burner.

16. The tiered burner of claim 11, wherein the plurality of vanes is four vanes.

17. The tiered burner of claim 11, wherein each burner port of each row of burner ports is arranged in a staggered formation, such that a top portion of the burner ports is aligned with a bottom side of an outer edge of a first vane, and a bottom portion of the burner ports is aligned with a top side of an inner edge of a second vane.

* * * * *